US008668808B2

(12) United States Patent
Strandqvist

(10) Patent No.: US 8,668,808 B2
(45) Date of Patent: Mar. 11, 2014

(54) FLUSHABLE MOIST WIPE OR HYGIENE TISSUE

(75) Inventor: Mikael Strandqvist, Lindome (SE)

(73) Assignee: SCA Hygiene Products AB, Gothenburg (SE)

( * ) Notice: Subject to any disclaimer, the term of this patent is extended or adjusted under 35 U.S.C. 154(b) by 1 day.

(21) Appl. No.: 13/500,181

(22) PCT Filed: Oct. 16, 2009

(86) PCT No.: PCT/SE2009/051192

§ 371 (c)(1), (2), (4) Date: Apr. 4, 2012

(87) PCT Pub. No.: WO2011/046478

PCT Pub. Date: Apr. 21, 2011

(65) Prior Publication Data

US 2012/0199301 A1 Aug. 9, 2012

(51) Int. Cl.

| | |
|---|---|
| ***D21H 15/06*** | (2006.01) |
| ***D21H 21/20*** | (2006.01) |
| ***D21H 27/38*** | (2006.01) |
| ***D04H 5/02*** | (2012.01) |

(52) U.S. Cl.

USPC ..... 162/115; 162/129; 162/130; 162/149; 442/118; 442/384; 442/408; 28/104

(58) Field of Classification Search

CPC ..... D21H 27/005; D21H 27/007; D04H 1/26; D04H 1/492; D04H 1/425; D04H 1/498

USPC ..... 162/115, 129, 130, 141, 146, 149; 442/408, 384, 118; 28/103–105

See application file for complete search history.

(56) References Cited

U.S. PATENT DOCUMENTS

| | | | | |
|---|---|---|---|---|
| 3,554,788 | A | 1/1971 | Fechileas | |
| 4,755,421 | A | 7/1988 | Manning et al. | |
| 6,028,018 | A | 2/2000 | Amundson et al. | |
| 6,110,848 | A | 8/2000 | Bouchette | |
| 6,163,943 | A * | 12/2000 | Johansson et al. | 28/104 |
| 6,749,718 | B2 | 6/2004 | Takai et al. | |
| 7,605,096 | B2 | 10/2009 | Tomarchio et al. | |
| 2002/0078538 | A1 | 6/2002 | Ngai | |
| 2003/0073367 | A1 | 4/2003 | Kopacz et al. | |
| 2003/0207636 | A1 * | 11/2003 | Gosavi et al. | 442/327 |
| 2004/0000382 | A1 | 1/2004 | Omura et al. | |
| 2004/0112783 | A1 | 6/2004 | Mukai et al. | |
| 2005/0148261 | A1 | 7/2005 | Close et al. | |
| 2009/0286437 | A1 | 11/2009 | Cunningham et al. | |

FOREIGN PATENT DOCUMENTS

| | | |
|---|---|---|
| CA | 841938 | 5/1970 |
| EP | 0 303 528 | 5/1993 |
| EP | 0 671 496 | 4/1999 |
| EP | 1 302 592 | 4/2003 |
| EP | 1 039 024 | 6/2003 |
| EP | 1 138 823 | 6/2003 |
| EP | 0 904 933 | 4/2004 |
| EP | 1 091 042 | 5/2004 |
| EP | 0 602 881 | 12/2004 |
| EP | 1 320 458 | 3/2009 |
| EP | 1 828 461 | 4/2010 |
| EP | 1 828 462 | 4/2010 |
| EP | 1 333 868 | 5/2011 |
| EP | 2 126 176 | 10/2011 |
| JP | 11-93055 | 4/1999 |
| JP | 2006-181764 | 7/2006 |
| WO | 98/29590 | 7/1998 |
| WO | 00/05065 | 2/2000 |
| WO | 01/48291 | 7/2001 |
| WO | 01/53590 | 7/2001 |
| WO | 2010/019726 | 2/2010 |
| WO | 2011/151748 | 12/2011 |
| WO | 2011/151749 | 12/2011 |

* cited by examiner

*Primary Examiner* — Eric Hug

(74) *Attorney, Agent, or Firm* — Drinker Biddle & Reath LLP

(57) ABSTRACT

A flushable moist wipe or hygiene tissue including a hydraulically entangled nonwoven material impregnated with a wetting composition. The nonwoven material contains at least 70%, by fiber weight, pulp fibers and the rest manmade fibers and/or natural fibers with a length of at least 6 mm. The moist wipe or hygiene tissue has a length in the machine direction which exceeds the width in the cross-machine direction with at least 25%. The moist wipe or hygiene tissue has a wet strength in machine direction which is at least 3 times higher than the wet strength in cross-machine direction, wherein the wet strength in cross-machine direction is between 50 and 200 N/m.

4 Claims, No Drawings

FLUSHABLE MOIST WIPE OR HYGIENE TISSUE

CROSS-REFERENCE TO PRIOR APPLICATION

This application is a §371 National Stage Application of PCT International Application No. PCT/SE2009/051192 filed Oct. 16, 2009, which is incorporated herein in its entirety.

TECHNICAL FIELD

The present disclosure refers to a moist wipe or hygiene tissue including a hydraulically entangled nonwoven material impregnated with a wetting composition. It is especially related to moist toilet paper and other wipes or hygiene tissue intended to be flushable in a sewer.

BACKGROUND

Pre-moistened wipes or hygiene tissue, are commonly used for cleansing different parts of the human body. Examples of specific uses are for baby care, hand wiping, feminine care and as toilet paper or a complement to toilet paper.

Since a long period of time often elapses from the time of manufacture of pre-moistened wipes until the time of use, they must have a sufficient structural integrity for their intended wiping function during such period. Adding a wet strength agent to the wipe will provide such wet integrity. However, especially when used as toilet paper, there is a strong desire that the wipe or tissue can be flushed in the sewer without causing problems with blocked pipes and filters. Wipes or tissue having a high wet strength will not disintegrate or break up into small fibre clumps when flushed in conventional household toilet systems, which may cause plugging of the drainage system.

It is previously known, for example through U.S. Pat. No. 3,554,788 to use an adhesive having a water-soluble component as a bonding agent in a water dispersible nonwoven material. The material is alleged to have a good dry strength but readily disperses in water and is flushable. This nonwoven material is packaged in dry condition and would not retain sufficient structural integrity for any longer period of time as is required for wet wipes.

A wet wipe made of a hydroentangled three ply sandwich structure including outer layers of synthetic fibers and a middle layer of cellulosic fibers is known through U.S. Pat. No. 6,110,848.

Most moist flushable pre-moistened toilet papers which are on the market today are flushable due to their small size. They can move along the drainage and sewage pipes, but are not readily dispersible and may therefore cause problems with blocked pipes and filters.

US 2004/0112783 discloses dry tissue paper and a storage box therefore, wherein the tissue paper is prevented from being torn when removed from the box by having specified tensile strength in longitudinal and lateral direction. In a dry condition the longitudinal tensile strength is 2.5 to 3.5 times higher than the lateral tensile strength.

JP-A-2006181764 discloses a water-degradable wipe formed using a hydration paper having a multi-ply structure. The water-degradable wipe is impregnated with an aqueous washing agent containing metal ion of alkaline metal ion. It has a ratio of wet strength in machine direction and cross machine direction of 1.0 to 3.5 and a wet strength in cross machine direction of less than 0.5 N/25 mm.

SUMMARY

It is desired to provide a moist wipe or hygiene tissue intended to be flushable in a sewer. This can be solved by the fact that the moist wipe or hygiene tissue includes a hydraulically entangled nonwoven material impregnated with a wetting composition, said nonwoven material containing at least 70%, by fibre weight, pulp fibres and the rest manmade fibres and/or natural fibres with a length of at least 6 mm and said moist wipe or hygiene tissue has a length in the machine direction and a width in the cross-machine direction, wherein the length exceeds the width with at least 25%, and wherein said moist wipe or hygiene tissue has a wet strength in machine direction which is at least 3 times higher than the wet strength in cross-machine direction, wherein the wet strength in cross-machine direction is between 50 and 200 N/m.

The wet strength in the machine direction may be at least 4 times and preferably at least 5 times higher than in the cross-machine direction.

The wet strength in the machine direction may be up to 10 times higher than in the cross-machine direction.

Said manmade fibres or natural fibres may have a fibre length of up to 15 mm.

The moist wipe or hygiene tissue may contain not more than 0.1% by weight, as calculated on the dry weight, of a wet strength agent.

The moist wipe or hygiene tissue may have a length in machine direction which exceeds the width in cross-machine direction with at least 50%.

The moist wipe or hygiene tissue may be a moist toilet paper.

The moist wipe or hygiene tissue may have a basis weight between 40 and 100 g/m$^2$.

The moist wipe or hygiene tissue may have a wet strength in cross-machine direction of between 60 and 160 N/m.

The moist wipe or hygiene tissue may contain at least 5% by fibre weight manmade fibres and/or natural fibres with a length of at least 6 mm.

DESCRIPTION OF PREFERRED EMBODIMENTS

A premoistened wipe or hygiene tissue includes a hydroentangled nonwoven material impregnated with a wetting composition. The wetting composition may contain a major proportion of water and other ingredients depending on the intended use. Wetting compositions useful in moist wipes and hygiene tissue are well-known in the art.

Hydroentangling or spunlacing is a technique for forming a nonwoven web introduced during the 1970's, see e g CA patent no. 841 938. The method involves forming a fibre web, which is either drylaid or wetlaid, after which the fibres are entangled by means of very fine water jets under high pressure. Several rows of water jets are directed against the fibre web, which is supported by a movable foraminous support or a perforated drum. In this process, the fibres entangle with one another providing sufficient bonding strength to the fibrous web without the use of chemical bonding agents. The entangled fibrous web is then dried. The fibres that are used in the material can be natural fibres, especially cellulosic pulp fibres, manmade staple fibres, and mixtures of pulp fibres and staple fibres. Spunlace materials can be produced with high quality to a reasonable cost and they possess a high absorption capacity.

The fibres used in the moist wipe or hygiene tissue can be at least 70%, by fibre weight, pulp fibres and the rest manmade fibres and/or natural fibres with a length of at least 6 mm. In particular embodiments, the moist wipe or hygiene tissue contains at least 5%, by fibre weight, manmade fibres and/or natural fibres having a length of at least 6 mm. The manmade fibres may be synthetic, e g polyester, polyamide, polyethylene, polypropylene, polylactides and copolymers thereof or staple fibres of regenerated cellulose, such as viscose, rayon, lyocell or the like. The natural fibres with a fibre length of at least 6 mm may be cotton fibres, sisal, hemp, ramie, flax etc.

Cellulose pulp fibres can be selected from any type of pulp and blends thereof. In particular embodiments, the pulp is characterized by being entirely natural cellulosic fibres and can include wood fibres as well as cotton. In advantageous embodiments, the pulp fibres are softwood papermaking pulp, although hardwood pulp and non-wood pulp, such as hemp and sisal may be used. The length of pulp fibres may vary from less than 1 mm for hardwood pulp and recycled pulp, to up to 6 mm for certain types of softwood pulp. Pulp fibres are advantageous to use since they are inexpensive, readily available and absorbent.

Short pulp fibres however have a rather poor capability to intertwine and entangle with each other during hydroentangling and are therefore usually mixed with longer fibres in order to produce a hydroentangled web with sufficient strength. These longer fibres having an average fibre length of at least 6 mm may be manmade fibres and/or natural fibres as mentioned above. In particular embodiments, said longer fibres have a fibre length of not more than 15 mm. The fineness of the longer fibres can vary between 0.3 dtex and 6 dtex.

The fibres are mixed and formed into a fibrous web. The fibrous web is either dry formed or wetlaid. In a wet-laid process the fibres are dispersed in a liquid, normally water, in a similar way as in a papermaking process and the dilute fibre dispersion is deposited on the foraminous support member where it is dewatered to form a continuous web-like material. The fibre dispersion may be diluted to any consistency that is typically used in conventional papermaking process. A foam forming process is a variant of a wet-laying process and a surfactant is added to the fibre dispersion, which is foamed, and the foamed fibre dispersion is deposited on the foraminous support. A very even fibre distribution is achieved in a foam forming process and it is also possible to use longer fibres than in a conventional wet-laying process.

The formed fibrous web is then subjected to hydroentanglement from several rows of nozzles, from which water jets at a high pressure are directed towards a fibrous web, while this is supported by the foraminous support member. The fibrous web is drained over suction boxes. Thereby, the water jets accomplish an entanglement of the fibrous web, i.e. an intertwining of the fibres. Appropriate pressures in the entanglement nozzles are adapted to the fibrous material, grammage of the fibrous web, etc. The water from the entanglement nozzles is removed via the suction boxes and is pumped to a water purification plant, and is then re-circulated to the entangling stations.

For a further description of the hydroentanglement or, as it is also called, spunlacing technology, reference is made e.g. to CA patent No. 841 938.

Hydroentangling may occur in one or several steps and from one side of the web or from both sides thereof. The web may be transferred to another foraminous support between two subsequent hydroentangling steps.

The entangled material is dewatered and brought to a drying station for drying before the finished material is reeled up and converted. Drying can be performed by blowing hot air through the fibrous web, by IR dryers or other non-compacting drying technique.

The entangled web is converted into wipes or hygiene tissue of appropriate dimensions, wherein the wipe or hygiene tissue should have a length in the machine direction of the web and a width in the cross machine direction of the web, wherein the length exceeds the width with at least 25%. The shape of the wipe or hygiene tissue may be rectangular or any other optional shape as long as the length/width relationship is as stated above. If the length and/or width vary along the wipe or hygiene tissue it is the maximum length in machine direction and the maximum width in cross-machine direction that is referred to.

Suitable dimensions for a flushable wipe or hygiene tissue are: a length between 9 and 25 cm and a width between 7 cm and 15 cm.

The wet strength of the wipe or hygiene tissue should be at least 3, preferably at least 4 and more preferably at least 5 times higher in the machine direction than in the cross-machine direction. The wet strength may be up to 10 times higher in the machine direction than in the cross-machine direction.

The wet strength in the cross-machine direction should be between 50 and 200 N/m.

The wet strength is measured with water according to the test method SS-EN ISO12625-5:2005.

The basis weight of the wipe or hygiene tissue is preferably between 40 and 100 g/m$^2$ as calculated on the dry weight of the fibrous material, excluding the wetting composition.

The above wet strength properties make the wipe or hygiene tissue strong in the direction usually used for wiping, i.e. the length direction of the product. This reduces the risk for breaking and poking during use. It is further relatively weak in the width direction, which is normally under less stress during wiping, making it possible for the wipe to break up and disperse in the sewage after use.

The relatively low strength in cross-machine direction may be accomplished by controlling the hydroentangling process, for example the pressure in the entanglement nozzles and/or the web speed through the process. Thus by lowering the pressure in the entanglement nozzles and/or increasing the speed through the process, the strength properties of the hydroentangled web will usually be lowered, especially the strength in the cross-machine direction. The strength in the machine direction will always be higher due to the fibre orientation and not effected by the hydroentangling process to the same extent as the cross-machine direction strength. It is also known that the fibre orientation in machine direction can be effected during the formation of the fibre web by controlling the speed of the jet of the fibre dispersion from the inlet box relative to the speed of the forming wire.

The wipe or hygiene tissue may be creped, embossed or otherwise textured to enhance softness of the product. Normally, working the web to enhance softness tends to reduce the wet strength of the web.

The wipe or hygiene tissue is impregnated with a wetting composition containing ingredients depending on the intended use of the product. A major proportion of the wetting composition is normally water. Other ingredients may include cleansing agents, skin care agents, bactericides, fungicides, emollients, perfumes, preservatives etc. depending on the intended use.

One use of the wipe or hygiene tissue can be as a moist toilet paper. As an example, a suitable wetting composition in a moist toilet paper may be aqueous based and may contain ingredients like propylene glycol, phenoxy ethanol, cocoglycocide, polyaminopropyl biguanide, dehydroacetic acid, perfume, cocoamidopropyl betaine, chamomilla recutita, bisabolol, citric acid, amylcinnamal, citonellol, hexylcinnamaldehyd, butylphenylmethylpropional and the like.

The wipe or hygiene tissue may contain no or very small amounts of a wet strength agent. A "small amount" is herein defined as up to 0.1 wt % wet strength agent calculated on the dry weight of the wipe or hygiene tissue. High amounts of wet strength agent will deteriorate the flushability of the wipe and make it more difficult to break up and disperse in a sewer.

The moist wipe or hygiene tissue is either individually packed in a sealed package that can be torn open by the user, or a dispenser containing a large number of wipes or tissue that may be dispensed through a dispenser opening in the dispenser.

Below are exemplified embodiments with test results.

EXAMPLES

Test materials were produces as described below.

A fiber dispersion was made from water and a mixture of pulp fibres and manmade staple length fibres. The fibrous web was hydroentangled from one or both sides. The total energy supply at the hydroentangling was between 160 and 200 kWh/ton material.

The fibrous web was then dewatered by vacuum suction boxes and dried by through-air-drying technique.

The fibres used for forming the fibrous web had the following composition:

Ex. 1: 24.3 wt % Lyocell from Lenzing Fibers, 1.7 dtex/15 mm.

75.7 wt % cellulose (bleached sulphate pulp fibres GSM supersoft plus from International Paper).

The web was hydroentangled from one side. The energy supply at the hydroentangling was 163 kWh/ton and the web speed was 158 m/min.

Ex. 2: 24.3 wt % Lyocell as in Example 1.

75.7 wt % cellulose as in Example 1.

The web was hydroentangled from one side. The energy supply at the hydroentangling was 179 kWh/ton and the web speed was 156 m/min.

Ex. 3: 24.3 wt % Lyocell as in Example 1.

75.7 wt % cellulose as in Example 1.

The web was hydroentangled from both sides. The energy supply at the hydroentangling was 179 kWh/ton and the web speed was 158 m/min.

Ex. 4 30 wt % Lyocell as in Example 1.

70 wt % cellulose as in Example 1.

The web was hydroentangled from both sides. The energy supply at the hydroentangling was 200 kWh/ton and the web speed was 158 m/min.

Ex. 5 30 wt % Lyocell as in Example 1.

70 wt % cellulose as in Example 1.

The web was hydroentangled from one side. The energy supply at the hydroentangling was 170 kWh/ton and the web speed was 158 m/min.

Ex. 6 20 wt % Lyocell as in Example 1.

5 wt % polypropylene from Fibervisions designated Create WL 1.7 dtex/6 mm.

75 wt % cellulose as in Example 1.

The web was hydroentangled from one side. The energy supply at the hydroentangling was 197 kWh/ton and the web speed was 149 m/min.

Ex. 7 25 wt % Lyocell as in Example 1.

75 wt % cellulose as in Example 1.

The web was hydroentangled from one side. The energy supply at the hydroentangling was 151 kWh/ton and the web speed was 171 m/min.

Evaluations concerning strength properties both in dry and wet conditions gave the results presented in Table 1 below:

TABLE 1

| Sample | Grammage ($g/m^2$) | Dry strength MD (N/m) | Dry strength CD (N/m) | Wet strength MD (N/m) | Wet strength CD (N/m) | MD/CD wet |
|---|---|---|---|---|---|---|
| 1 | 68.8 | 1323 | 210 | 573 | 110 | 5.2 |
| 2 | 68.5 | 1503 | 153 | 659 | 84 | 7.8 |
| 3 | 67.9 | 1528 | 199 | 776 | 106 | 7.3 |
| 4 | 70.9 | 1949 | 217 | 1010 | 124 | 8.1 |
| 5 | 67.6– | 1607 | 260 | 822 | 143 | 5.7 |
| 6 | 65.6 | 846 | 245 | 355 | 110 | 3.0 |
| 7 | 66.7 | 1058 | 297 | 554 | 169 | 3.3 |

The following test methods were used:

Grammage: SS-EN-ISO 12625-6:2005;

Dry strength: SS-EN-ISO 12625-4:2005;

Wet strength: SS-EN ISO12625-5:2005 (measured in water).

The invention claimed is:

1. A flushable moist wipe or hygiene tissue having a basis weight between 40 and 100 $g/m^2$ and comprising a layer of hydraulically entangled nonwoven material impregnated with a wetting composition, said layer of nonwoven material containing at least 70%, by fibre weight, pulp fibres and at least 5%, by fibre length, manmade fibres, natural fibres, or combinations thereof with a length of at least 6 mm and up to 15 mm and said moist wipe or hygiene tissue has a length in the machine direction and a width in the cross-machine direction, wherein said layer of nonwoven material has a wet strength in machine direction which is at least 5 times and up to 10 times higher than the wet strength in cross-machine direction, wherein the wet strength in cross-machine direction is between 50 and 200 N/m and wherein the length of the moist wipe or hygiene tissue exceeds the width with at least 25%, said moist wipe contains not more than 0.1% by weight, as calculated on the dry weight, of a wet strength agent.

2. The moist wipe or hygiene tissue according to claim 1, having a length in machine direction which exceeds the width in cross-machine direction with at least 50%.

3. The moist wipe or hygiene tissue according to claim 1 is a moist toilet paper.

4. The moist wipe or hygiene tissue according to claim 1, wherein said layer of nonwoven material has a wet strength in cross-machine direction of between 60 and 160 N/m.

* * * * *